US011086254B2

(12) United States Patent
Okumura

(10) Patent No.: US 11,086,254 B2
(45) Date of Patent: Aug. 10, 2021

(54) IMAGE FORMING APPARATUS USING DEVELOPER CONTAINING TONER PARTICLE AND CARRIER LIQUID

(71) Applicant: CANON KABUSHIKI KAISHA, Tokyo (JP)

(72) Inventor: Shohei Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/880,735

(22) Filed: May 21, 2020

(65) Prior Publication Data

US 2020/0285174 A1 Sep. 10, 2020

Related U.S. Application Data

(63) Continuation of application No. PCT/JP2018/043564, filed on Nov. 27, 2018.

(30) Foreign Application Priority Data

Nov. 28, 2017 (JP) ..... JP2017-228154

(51) Int. Cl.
*G03G 15/16* (2006.01)
*G03G 15/01* (2006.01)

(52) U.S. Cl.
CPC ..... *G03G 15/161* (2013.01); *G03G 15/0121* (2013.01); *G03G 15/1615* (2013.01); *G03G 2215/0122* (2013.01)

(58) Field of Classification Search
CPC ..... G03G 15/161; G03G 15/1615; G03G 15/162; G03G 15/0121; G03G 2215/0122
See application file for complete search history.

(56) References Cited

U.S. PATENT DOCUMENTS 5,778,291 A * 7/1998 Okubo ..... G03G 15/162 399/299
8,983,323 B2 * 3/2015 Yamashita ..... G03G 15/1615 399/66
2003/0044203 A1 3/2003 Watanabe
2003/0095814 A1 * 5/2003 Miyakawa ..... G03G 15/1605 399/252
2005/0244197 A1 11/2005 Sasamoto et al.
2013/0216281 A1 * 8/2013 Suzuki ..... G03G 15/1605 399/314

(Continued)

FOREIGN PATENT DOCUMENTS

JP H07-319256 A 12/1995
JP 2002-318494 A 10/2002

(Continued)

*Primary Examiner* — Sophia S Chen

(74) *Attorney, Agent, or Firm* — Canon U.S.A., Inc. IP Division

(57) ABSTRACT

An image forming apparatus includes an image bearing member on which a toner image is formed by a liquid developer containing a toner particle and a carrier liquid, an intermediate transfer belt onto which the toner image is transferred, and a transfer member configured to transfer the toner image from the image bearing member onto the intermediate transfer belt. The transfer member is made of a metal, and the transfer member abuts against the image bearing member with the intermediate transfer belt nipped therebetween.

8 Claims, 11 Drawing Sheets

(56) References Cited

U.S. PATENT DOCUMENTS

| | | | | |
|---|---|---|---|---|
| 2013/0272735 | A1* | 10/2013 | DiRubio | G03G 15/161 399/66 |
| 2015/0003852 | A1* | 1/2015 | Yamashita | G03G 21/06 399/46 |
| 2017/0168405 | A1* | 6/2017 | Uchida | G03G 15/161 |
| 2018/0136589 | A1* | 5/2018 | Sakamoto | G03G 15/162 |
| 2018/0356752 | A1* | 12/2018 | Kawanago | G03G 15/161 |

FOREIGN PATENT DOCUMENTS

| | | | |
|---|---|---|---|
| JP | 2007-108788 | A | 4/2007 |
| JP | 2008-083319 | A | 4/2008 |
| JP | 2010-020006 | A | 1/2010 |
| JP | 2010-048846 | A | 3/2010 |
| JP | 5016146 | B2 | 9/2012 |
| JP | 2015-227952 | A | 12/2015 |
| JP | 2016-224191 | A | 12/2016 |

* cited by examiner

IMAGE FORMING APPARATUS USING DEVELOPER CONTAINING TONER PARTICLE AND CARRIER LIQUID

CROSS-REFERENCE TO RELATED APPLICATIONS

This application is a Continuation of International Patent Application No. PCT/JP2018/043564, filed Nov. 27, 2018, which claims the benefit of Japanese Patent Application No. 2017-228154, filed Nov. 28, 2017, both of which are hereby incorporated by reference herein in their entirety.

BACKGROUND OF THE INVENTION

Field of the Invention

The present invention relates to an electrophotographic type of image forming apparatus that forms an image using a liquid developer.

Description of the Related Art

In the related art, there is known an image forming apparatus that forms a toner image on an image bearing member such as a photosensitive drum, primarily transfers the formed toner image onto an intermediate transfer belt, and secondarily transfers the primarily transferred toner image onto a recording medium such as a sheet.

In such an image forming apparatus, there is a phenomenon called a dropout where a part of a toner image such as a character or a thin line transferred onto the intermediate transfer belt is lost. It is considered that the dropout occurs due to an increase in cohesive force between toners or in adhesion between the toner and a surface of the image bearing member which is due to the toner in a transfer portion receiving a pressure. As a countermeasure against the dropout, it is known to be effective to lower the contact pressure of the transfer member with respect to the image bearing member (Japanese Patent Laid-Open No. 2015-227952).

In addition, as a method of lowering the pressure in the transfer portion, there is disclosed a configuration where the transfer member is disposed to be offset with respect to the image bearing member in a movement direction of the intermediate transfer belt such that the transfer member does not abut against the image bearing member (Japanese Patent Publication No. 5016146).

On the other hand, as a developer used to form a toner image on the image bearing member, there are a dry developer and a liquid developer, and it is known that due to a reduction in toner particle size, the liquid developer provides higher image quality compared to the dry developer.

However, as disclosed in Japanese Patent Publication No. 5016146, when the transfer member is offset with respect to the image bearing member in order to prevent the occurrence of the dropout, there are following problems. Namely, since the intermediate transfer belt is not configured to be nipped between the transfer member and the image bearing member, there may occur a phenomenon where as illustrated in FIG. 1, the intermediate transfer belt undulates in the transfer portion in a width direction of the intermediate transfer belt (hereinafter, referred to as an undulation). When such an undulation of the belt occurs, a gap is formed between a transfer roller and the intermediate transfer belt, so that abnormal discharge occurs. Such an abnormal discharge causes a decrease in image quality, which is a problem. For example, due to such an abnormal discharge, the surface resistivity of the intermediate transfer belt may decrease locally, and a white vertical streak-shaped image quality defect may occur on an output image. On the other hand, when the intermediate transfer belt is nipped between the transfer member and the image bearing member, as illustrated in FIG. 2, an undulation of the intermediate transfer belt in a transfer nip is eliminated. However, an increase in peak pressure in the transfer portion increases a risk of the occurrence of the dropout. Particularly, when an inexpensive metal roller is used as the transfer member, the transfer pressure increases, and the dropout occurs easily.

Therefore, it is desirable to provide an image forming apparatus that is capable of preventing abnormal discharge from occurring due to an undulation of a belt while preventing the occurrence of a dropout, even when the image forming apparatus is configured to use a metal roller as a transfer member.

SUMMARY OF THE INVENTION

An image forming apparatus has the following configuration to solve the problems. According to an aspect of the present invention, there is provided an image forming apparatus including a photosensitive drum configured to bear an image, a developing device configured to develop a latent image, which is formed on the photosensitive drum, into a toner image, an intermediate transfer belt which is provided to face the photosensitive drum, and onto which the toner image formed on the photosensitive drum is transferred, and a transfer roller provided to face the photosensitive drum with the intermediate transfer belt nipped therebetween, and configured to apply a transfer bias to transfer the toner image, which is formed on the photosensitive drum, onto the intermediate transfer belt. The transfer roller is a metal roller made of a metal. The developing device is configured to develop the latent image using a liquid developer containing a toner particle and a carrier liquid.

According to the present invention, it is possible to provide the image forming apparatus that is capable of preventing abnormal discharge from occurring due to an undulation of the belt while preventing the occurrence of a dropout, even when the image forming apparatus is configured to use a metal roller as the transfer member.

Further features of the present invention will become apparent from the following description of exemplary embodiments with reference to the attached drawings.

DESCRIPTION OF THE EMBODIMENTS

Hereinafter, the present invention will be specifically described with reference to embodiments. Incidentally, these embodiments are exemplary embodiments of the present invention, and the present invention is not limited by these embodiments.

In the present embodiments, only main parts relating to the formation and the transfer of a toner image will be described; however, the present invention can be implemented in various forms such as a printer, various printing machines, copying machines, FAX machines, and multifunction machines by adding necessary devices, equipment, a housing structure, and the like to the main parts.

First Embodiment

Figure 1A:
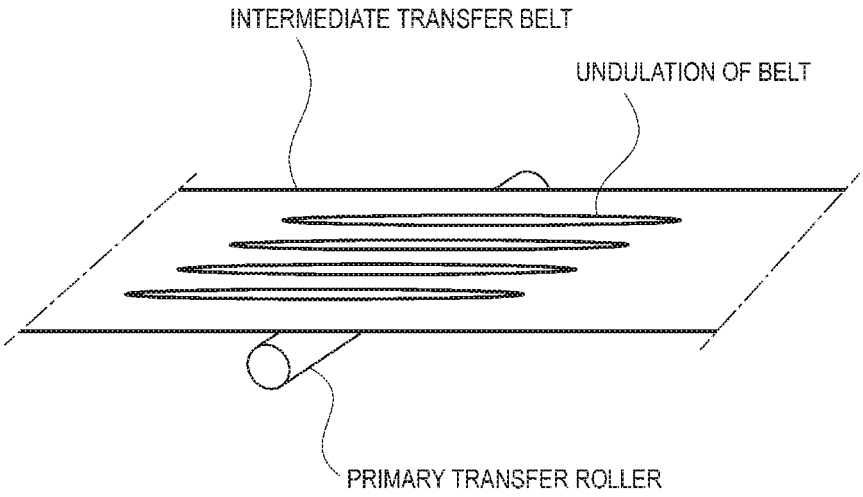
FIG. 1A is a perspective view illustrating a primary transfer roller, an intermediate transfer belt, and a mode of an undulation of the intermediate transfer belt when the primary transfer roller does not abut against an image bearing member.
Figure 1B:
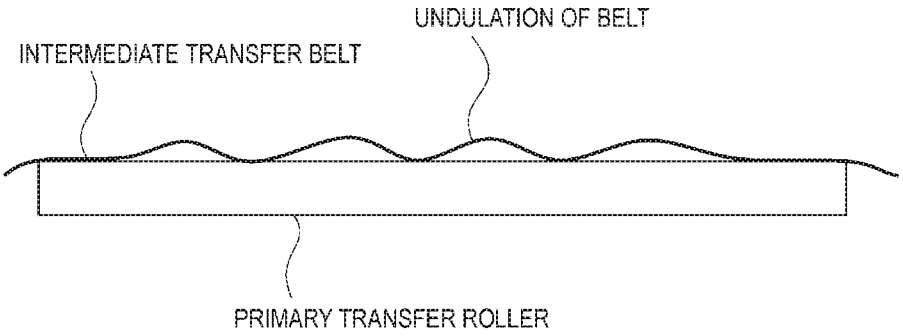
FIG. 1B is a view seen from a downstream side in a conveying direction of the intermediate transfer belt.
Figure 2A:
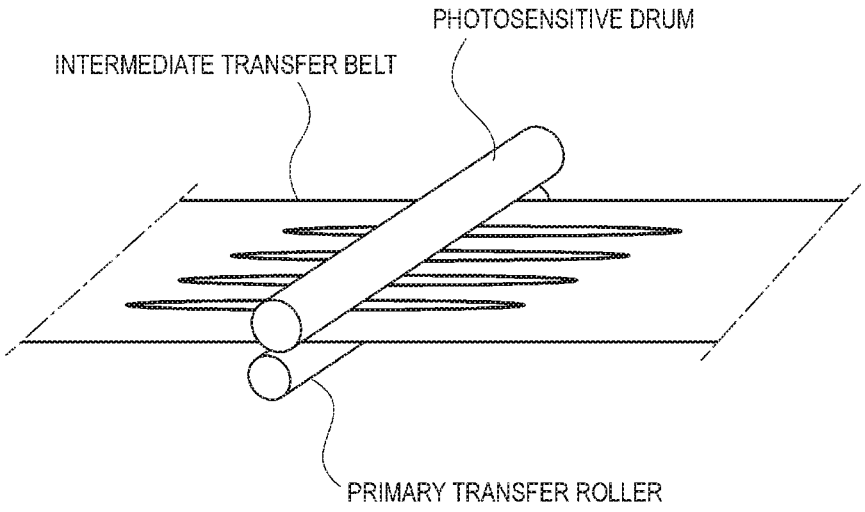
FIG. 2A is a perspective view illustrating the primary transfer roller, the intermediate transfer belt, and a mode of an undulation of the intermediate transfer belt when the primary transfer roller abuts against the image bearing member.
Figure 2B:
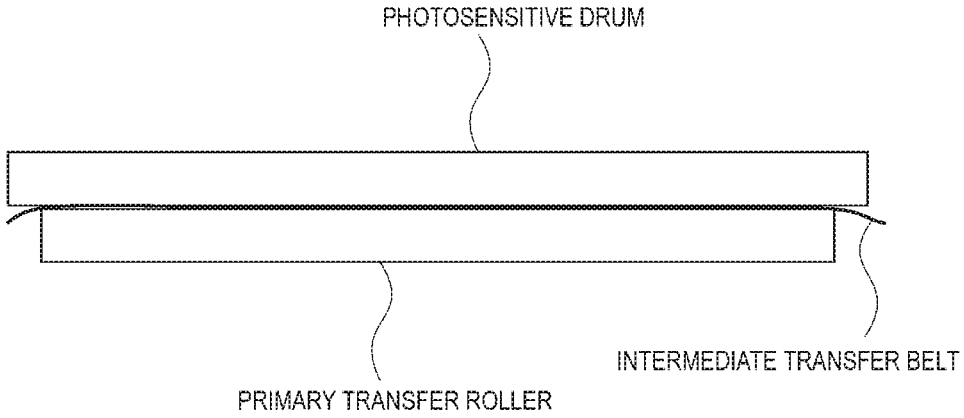
FIG. 2B is a view seen from the downstream side in the conveying direction of the intermediate transfer belt.
Figure 3:
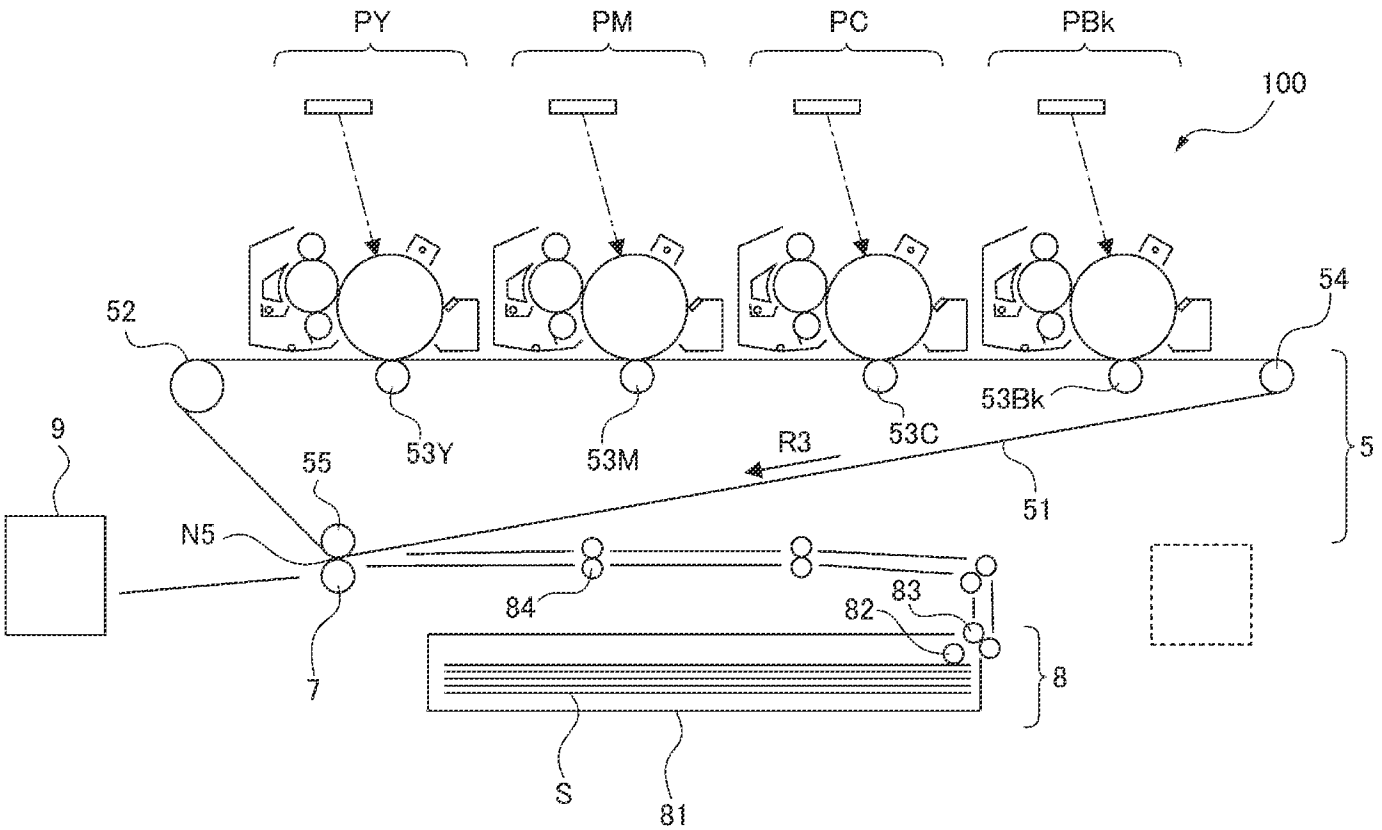
FIG. 3 is a schematic configuration view of a first embodiment and a second embodiment of the present invention.

A first embodiment will be described. Firstly, a schematic configuration of an image forming apparatus of the present embodiment will be described with reference to FIG. 3.

[Image Forming Apparatus]

An image forming apparatus 100 of the present embodiment is a tandem-type intermediate transfer-type full-color printer where a plurality of image forming portions PY, PM, PC, and PBk is arranged. In the present embodiment, four image forming portions PY to PBk are disposed at equal intervals along a movement direction of an intermediate transfer belt 51 in order of yellow (Y), magenta (M), cyan (C), and black (Bk) from an upstream side in the movement direction. In an intermediate transfer unit 5, the intermediate transfer belt 51 extends around a driving roller 52, primary transfer rollers 53Y to 53Bk, a tension roller 54, and an opposed roller 55. The tension roller 54 is pressed outward with a predetermined force (for example, 80 N) such that the intermediate transfer belt 51 does not become loose. In this way, tension is exerted on the intermediate transfer belt 51, and the driving roller 52 is rotated by a driving unit (not illustrated), so that the intermediate transfer belt 51 rotate in an arrow R3 direction.

The image forming apparatus 100 outputs a color image, which is formed according to image information from an external host apparatus (not illustrated) such as a personal computer or an image reading apparatus which is capable of communicating with an apparatus main body of the image forming apparatus 100, onto a recording material S. Examples of the recording material S include a cut sheet having an average basis weight of 50 to 400 g/m2 and an over head transparency (OHT) sheet. When the image forming apparatus 100 outputs a color image, the image forming apparatus 100 generates an image signal where color separation is done according to a print signal sent from the external host apparatus, and causes the image forming portions PY to PBk to form color toner images according to the image signal. The color toner images formed by the image forming portions PY to PBk are sequentially multiplex-transferred onto the intermediate transfer belt 51 moving in a predetermined direction, and the toner images which are multiplex-transferred onto the intermediate transfer belt 51 are collectively transferred onto the recording material S. The recording material S onto which the toner images are collectively transferred is conveyed to a fixing device 9 and is heated and pressed or irradiated with ultraviolet rays by the fixing device 9, so that the toner images are fixed onto the recording material S, and the recording material S onto which the toner images are fixed is exited outside an apparatus body.

[Liquid Developer]

In the present embodiment, a liquid developer in which a toner which is a dispersoid is dispersed in a carrier which is a dispersion medium is used. In the liquid developer, a toner which is resin particles having a median particle size of 1 μm and containing yellow, magenta, cyan, and black pigments is dispersed in a carrier made of a silicon solvent, hydrocarbons, ethers, and the like. As needed, a toner dispersant, a charge control agent, and the like are added to the liquid developer, and the volume resistivity of the liquid developer is 1E+10 Ω·cm or greater. The carrier is not limited to the foregoing carrier, and for example, a monomer having ultraviolet curing capability or the like can be used. The ratio of the toner to the liquid developer (hereinafter, referred to as T/D) is from 1 to 10 wt %, and the viscosity of the liquid developer is from 0.5 to 100 cP. Incidentally, in the present embodiment, a negatively charged toner is used.

[Image Forming Portion and Intermediate Transfer Unit]

The image forming portions PY to PBk which form yellow, magenta, cyan, and black color images, and the intermediate transfer unit 5 will be described with reference to FIG. 4. However, the configurations of the image forming portions PY to PBk are the same except that toner colors used in developing devices 4Y to 4Bk are different from each other, and unless it is particularly necessary to distinguish therebetween, the image forming portions will be described while Y, M, C, and Bk which are attached to the ends of the reference signs to distinguish between the image forming portions PY to PBk are omitted.

Figure 4:
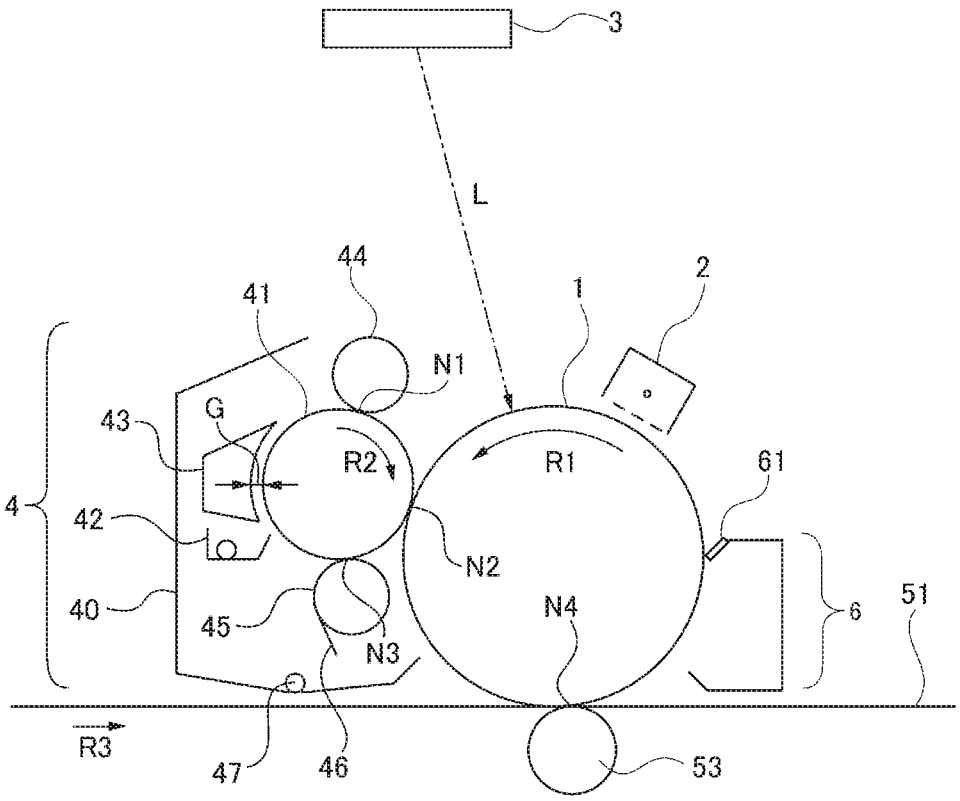
FIG. 4 is a cross-sectional configuration view of an image forming portion in the first embodiment and the second embodiment of the present invention.

As illustrated in FIG. 4, in the image forming portion P, a charging device 2, an exposure device 3, the developing device 4, the intermediate transfer unit 5, and a drum cleaning device 6 are disposed around a photosensitive drum 1.

The photosensitive drum 1 is a drum-shaped photoconductor. In the present embodiment, the photosensitive drum 1 in which a photosensitive layer made of amorphous silicon is formed on an outer peripheral surface of a conductive cylinder made of aluminum is used; however, an organic photoconductor (OPC) may be used. In the present embodiment, the photosensitive drum 1 having an outer diameter of 84 mm and a longitudinal width (length in a rotational axis direction) of 380 mm is used. The photosensitive drum 1 is rotated at a constant process velocity (for example, a circumferential velocity of 500 mm/sec) in an arrow R1 direction by a driving unit (not illustrated). Incidentally, generally, all of the photosensitive drum 1, a developing roller 41, and the intermediate transfer belt 51 are driven at substantially the same process velocity.

The charging device 2 is a scorotron-type corona charger, and charges the surface of the photosensitive drum 1 to a uniform negative dark-portion potential (for example, −500 V). The corona charger causes a high-voltage power supply (not illustrated) to apply a direct current voltage to a discharge wire made of tungsten or stainless steel and having a diameter of approximately 50 to 100 μm which is shielded with a metal such as aluminum, to charge the surface of the photosensitive drum 1.

The exposure device 3 is a laser scanner unit, and performs image exposure on the charged surface of the photosensitive drum 1. The laser scanner unit causes a laser light-emitting element to generate laser light L, which is obtained by performing on-off modulation on scanning line image data in which each color of a separated color image is deployed, and scans the charged surface of the photosensitive drum 1 with the laser light L using a rotating mirror. A potential drop occurs in an exposed portion of the surface of the photosensitive drum 1, so that a bright-portion potential (for example, −100 V) is formed. Accordingly, an electrostatic latent image corresponding to image information is formed on the surface of the photosensitive drum 1.

The developing device 4 develops the electrostatic latent image, which is formed on the surface of the photosensitive drum 1, using the liquid developer. In the developing device 4, as illustrated in FIG. 4, a supply tray 42, a developing electrode 43, a squeeze roller 44, a cleaning roller 45, and a removing member 46 are disposed around the developing roller 41 inside a developing container 40. The developing roller 41 is rotated in an arrow R2 direction by a driving unit (not illustrated), and the squeeze roller 44 and the cleaning roller 45 are also rotated in the same direction as that of the developing roller 41 on surfaces of the squeeze roller 44 and the cleaning roller 45 which face the developing roller 41. A developing bias (for example, ~300 V) having a median value between the foregoing dark-portion potential and the foregoing bright-portion potential is applied to the developing roller 41 by a high-voltage power supply (not illustrated). After the T/D of the liquid developer is adjusted and the liquid developer is stirred in a mixer (not illustrated), the liquid developer is supplied to the supply tray 42 via a circulation system (not illustrated).

The developing electrode 43 is disposed facing an opposite side of a surface of the developing roller 41, the surface facing the photosensitive drum 1, with a predetermined gap G (for example, 0.5 mm) between the developing electrode 43 and the developing roller 41, and the liquid developer is pumped up to the gap G from the supply tray 42 by the rotation of the developing roller 41.

An electrode bias (for example, −500 V) which is relatively more negative than the developing bias is applied to the developing electrode 43 by a high-voltage power supply (not illustrated). Accordingly, an electric field is generated in the gap G between the developing roller 41 and the developing electrode 43, and the toner in the liquid developer included in the gap G is drawn toward a developing roller 41 side of the gap G.

The squeeze roller 44 abuts against the developing roller 41, so that a nip portion N1 is formed, and a squeeze bias (for example, −350 V) which is relatively more negative than the developing bias is applied to the squeeze roller 44 by a high-voltage power supply (not illustrated). A part of the liquid developer on the developing roller 41 which has passed through the gap G passes through the nip portion N1, so that the film thickness on the developing roller 41 is uniformly regulated. On the other hand, the liquid developer which has not passed through the nip portion N1 flows along an upper surface of the developing electrode 43 to fall to a bottom of the developing container 40.

The developing roller 41 abuts against the photosensitive drum 1, so that a nip portion N2 is formed. When the liquid developer which has passed through the nip portion N1 reaches the nip portion N2, the toner moves onto the photosensitive drum 1 at a location where the bright-portion potential which is a potential that is relatively more positive than the developing bias is formed, so that the electrostatic latent image is reversely developed to form a toner image.

The cleaning roller 45 abuts against the developing roller 41, so that a nip portion N3 is formed, and a cleaning bias (for example, −100 V) which is relatively more positive than the developing bias is applied to the cleaning roller 45 by a high-voltage power supply (not illustrated). Accordingly, an electric field is generated between the developing roller 41 and the cleaning roller 45, and the toner which remains on the developing roller 41 after having passed through the nip portion N2 is electrostatically recovered by the cleaning roller 45. The removing member 46 is disposed downstream of the nip portion N3 in a rotational direction of the cleaning roller 45. The removing member 46 is a plate-shaped elastic member extending in a longitudinal direction of the cleaning roller 45, and abuts against the cleaning roller 45 to scrape off the toner or the carrier liquid on the cleaning roller 45. The carrier liquid removed by the cleaning roller 45 or the toner or the carrier liquid scraped off by the removing member 46 falls to the bottom of the developing container 40.

The liquid developer which has fallen to the bottom of the developing container 40 is exited through an exit port 47 communicating with the mixer.

The primary transfer roller 53 abuts against the photosensitive drum 1 so as to interpose the intermediate transfer belt 51 between the primary transfer roller 53 and the photosensitive drum 1, so that a nip portion N4 is formed, and a positive primary transfer bias (for example, 800 V) is applied to the primary transfer roller 53 by a primary transfer high-voltage power supply so as for a predetermined current (for example, 100 μA) to flow. Accordingly, an electric field is generated in the nip portion N4, and when the toner image on the photosensitive drum 1 reaches the nip portion N4, the toner moves onto the intermediate transfer belt 51, so that the toner image is primarily transferred.

A blade 61 abuts against the photosensitive drum 1 to mechanically scrape the toner which remains on the photosensitive drum 1 after having passed through the nip portion N4, so that the photosensitive drum 1 is cleaned.

When a yellow toner image formed in the PY is primarily transferred by the foregoing method, similarly, magenta, cyan, and black toner images formed in the PM to the PBk are primarily transferred onto the yellow toner image on the intermediate transfer belt 51 in a state where the positions of the toner images overlap one another.

A secondary transfer roller 7 abuts against the opposed roller 55 so as to interpose the intermediate transfer belt 51 between the secondary transfer roller 7 and the opposed roller 55, so that a nip portion N5 is formed, and a positive secondary transfer bias (for example, 1,500 V) is applied to the secondary transfer roller 7 by a high-voltage power supply (not illustrated). Accordingly, an electric field is generated in the nip portion N5.

A recording material feeding device 8 causes a separating device 83 to separate the recording materials S one by one which are pulled out from a sheet feeding cassette 81 by a pickup roller 82, and feeds the recording material S to a registration roller 84. The registration roller 84 receives the recording material S in a stop state to put the recording material S on standby, and feeds the recording material S to the nip portion N5 in synchronization with the toner images on the intermediate transfer belt 51.

When the recording material S is introduced into the nip portion N5, the toner on the intermediate transfer belt 51 moves onto the recording material, so that the toner images are secondarily transferred.

The toner images on the recording material S is heated and pressed by the fixing device 9, so that the toner images are fixed on the recording material S.

The recording material S which is subjected to the fixing process is exited outside the apparatus as an output object.

[Primary Transfer Portion]

The configuration of a primary transfer portion in the present embodiment will be described.

The intermediate transfer belt 51 which is an intermediate transfer member is a film-shaped endless belt having a constant thickness, and an intermediate transfer member which is made of a resin such as polyimide or polyamide or an alloy thereof containing a proper amount of an antistatic agent such as carbon black is used. The intermediate transfer belt 51 having a surface resistivity of 1E+9 to 1 E+13Ω/□ and a thickness of 0.04 to 0.1 mm is used.

The primary transfer roller 53 which is a primary transfer member has a straight shape having an outer diameter of 24 mm, and a metal such as SUS or SUM is used as the material of the primary transfer roller 53. Namely, an outer surface of the primary transfer roller 53 which abuts against the intermediate transfer belt 51 is made of a metal. The primary transfer roller 53 is disposed in a state where a center axis of the primary transfer roller 53 is offset 2 mm downstream of a center axis of the photosensitive drum 1 in the R3 direction, both ends of the primary transfer roller 53 are supported on bearings, and the primary transfer roller 53 is spring-pressed toward the direction of the photosensitive drum 1 at a predetermined pressure (for example, 40 N). Incidentally, in the present embodiment, the pressure (linear nipping pressure) of the transfer portion is set to 0.01 N/mm or greater to 0.15 N/mm.

Figure 5:
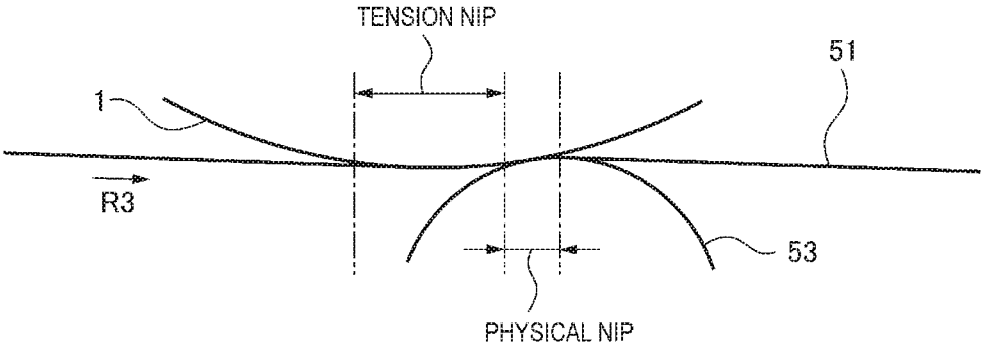
FIG. 5 is a view describing the configuration of a primary transfer nip.

Accordingly, as illustrated in FIG. 5, a region (hereinafter, referred to as a physical nip) where all of the photosensitive drum 1, the intermediate transfer belt 51, and the primary transfer roller 53 are in contact with each other is formed. In other words, when the center-to-center distance between the photosensitive drum 1 and the primary transfer roller 53 is Ld, the radius of the primary transfer roller 53 is r1, the radius of the photosensitive drum 1 is r2, and the thickness of the intermediate transfer belt 51 is r3, $Ld \leq r1+r2+r3$ is satisfied. In addition, the position of the primary transfer roller 53 is offset with respect to the photosensitive drum 1. In this way, in addition to the physical nip, a region (hereinafter, referred to as a tension nip) where only the photosensitive drum 1 and the intermediate transfer belt 51 are in contact with each other is formed in a region (hereinafter, referred to as a primary transfer nip) where the photosensitive drum 1 and the intermediate transfer belt are in contact with each other.

Here, as also described in the problem of the present invention, when a metal roller is adopted as the transfer member, the peak pressure in the transfer portion increases, and a dropout occurs easily. Therefore, in the present embodiment, a liquid development method is adopted as a development method. In the liquid development method, the liquid carrier can be supplied to the transfer portion, together with the toner. For this reason, it is possible to more greatly lower the cohesion between the toners compared to a dry development method; and thereby, it is possible to prevent a dropout. In addition, since the primary transfer roller 53 which is a metal roller abuts against the photosensitive drum with the intermediate transfer belt 51 nipped therebetween, it is possible to prevent abnormal discharge caused by an undulation of the belt.

Comparative Example A

The inventors of this application conducted a comparative experiment to demonstrate the effects of the present invention. Hereinafter, the configuration of Comparative Example A will be described.

Figure 6:
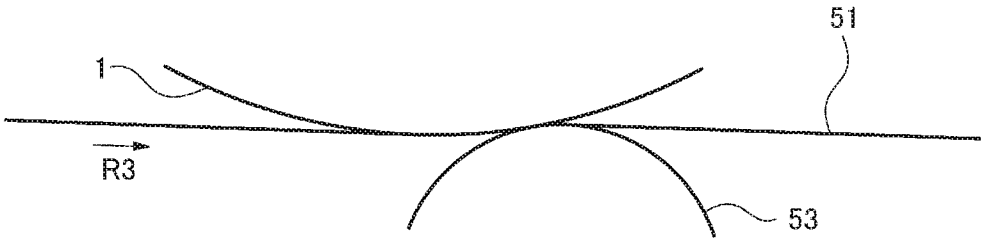
FIG. 6 is a cross-sectional view of a primary transfer portion in Comparative Example A of the first embodiment of the present invention.
Figure 7:
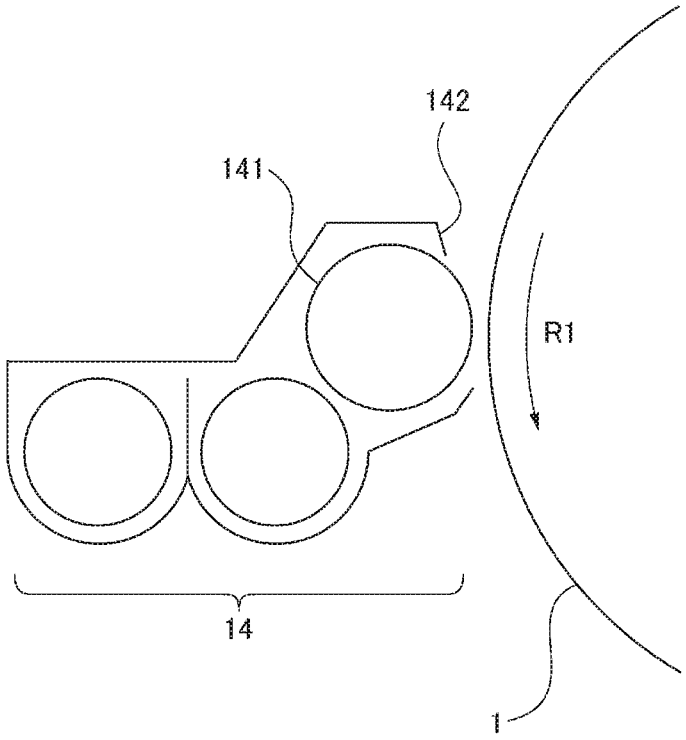
FIG. 7 is a cross-sectional view of a developing device in Comparative Example B of the first embodiment of the present invention.

Since Comparative Example A has substantially the same configuration as that of the first embodiment, and differs from the first embodiment only in the position of the primary transfer roller 53, only the configuration of the primary transfer portion of Comparative Example A will be described. In Comparative Example A, the center axis of the primary transfer roller 53 is offset 10 mm downstream of the center axis of the photosensitive drum 1 in the R3 direction. In addition, both ends of the primary transfer roller 53 are supported on bearings such that an uppermost point of the primary transfer roller 53 intrudes 0.1 mm into a lowermost point of the photosensitive drum 1, and are fixed to the intermediate transfer unit 5. As illustrated in FIG. 6, since the primary transfer roller 53 does not abut against the photosensitive drum 1, no physical nip is formed and only the tension nip is formed in the primary transfer nip.

Comparative Example B

The inventors of this application conducted a comparative experiment to demonstrate the effects of the present invention. Hereinafter, the configuration of Comparative Example B will be described.

Since Comparative Example B has substantially the same configuration as that of the first embodiment, and differs from the first embodiment only in the developing device, only the configuration of the developing device of Comparative Example B will be described.

A developing device 14 of Comparative Example B is the same as that of the first embodiment in that a latent image formed on the photosensitive drum 1 is developed. On the other hand, the developing device 14 of Comparative Example B differs from that of the first embodiment in that a dry two-component developer including non-magnetic toner particles and magnetic carrier particles is used. The developing device 14 stirs the dry two-component developer to charge the toner and the carrier to a negative polarity and a positive polarity, respectively. A developing sleeve 141 including a built-in fixed magnet rotates to bear and convey the dry two-component developer on a surface thereof. The dry two-component developer in a standing state, of which the layer thickness is regulated by a regulating member 142, rubs against the photosensitive drum 1, so that the toner is supplied to an electrostatic latent image formed on the photosensitive drum 1. In that time, a bias having a median value between a dark-portion potential and a bright-portion potential is applied to the developing sleeve by a high-voltage power supply (not illustrated), so that similar to the first embodiment, the electrostatic latent image is reversely developed.

[Decrease in Resistance of Intermediate Transfer Belt and Dropout]

The inventors of this application performed 5,000 sets of image formation on 100 sheets of A4-size recording materials, and confirmed whether or not a streak image occurred, and the surface resistivity of the intermediate transfer belt 51 before and after the image formation. The surface resistivity was measured using a resistivity meter Hiresta manufactured by Mitsubishi Chemical Corporation. In parallel with the above proceedings, the same study was conducted for Comparative Example A and Comparative Example B. Incidentally, this study was conducted in an environment of 23° C. and 5% RH.

Table 1 shows whether or not a streak image occurs, and the surface resistivity of the intermediate transfer belt 51 before and after the study.

TABLE 1

| | Occurrence of streak image (initial) | Occurrence of streak image (after study) | Surface resistivity (initial) [Ω/□] | Surface resistivity (after study) [Ω/□] |
|---|---|---|---|---|
| Present embodiment | Not occurred | Not occurred | 1E+11 | 9E+10 |
| Comparative Example A | Not occurred | Occurred | 1E+11 | 5E+9 |
| Comparative Example B | Not occurred | Not occurred | 1E+11 | 9E+10 |

As shown in Table 1, the occurrence of a streak image was not observed before and after the study in the present embodiment and Comparative Example B, whereas the occurrence of a streak image was confirmed after the study in Comparative Example A. In addition, there was almost no change in the surface resistivity of the intermediate transfer belt before and after the study in the present embodiment and Comparative Example B, whereas it was observed in Comparative Example A that the surface resistivity of the intermediate transfer belt after the study decreased by one digit or greater compared to that before the study. From these results, a correlation between the occurrence of a streak image and a decrease in the resistance of the intermediate transfer belt was found. In addition, a decrease in the resistance of the intermediate transfer belt hardly occurs in the present embodiment and Comparative Example B where the primary transfer roller is disposed such that the physical nip is formed in the primary transfer portion, and a decrease in the resistance of the intermediate transfer belt is noticeable in Comparative Example A where no physical nip is formed. Therefore, it can be found that when the primary transfer roller is disposed such that the physical nip is formed in the primary transfer portion, it is possible to further prevent the occurrence of a streak image compared to when no physical nip is formed.

The inventors of this application output a three-point character image using the image forming apparatus 100, and confirmed whether or not a dropout occurred. In addition, a contact pressure distribution between the photosensitive drum 1 and the intermediate transfer belt 51 was measured. The pressure distribution was measured using an I-SCAN manufactured by Nitta Corporation. In parallel with the above proceedings, the same study was conducted for Comparative Example A and Comparative Example B. Table 2 shows whether or not a dropout occurs, and the peak value of the contact pressure distribution.

TABLE 2

| | Occurrence of dropout | Peak pressure [MPa] |
|---|---|---|
| Present embodiment | Not occurred | 0.040 |
| Comparative Example A | Not occurred | 0.006 |
| Comparative Example B | Occurred | 0.040 |

As shown in Table 2, the occurrence of a dropout was not observed in the present embodiment and Comparative Example A, whereas the occurrence of a dropout was confirmed in Comparative Example B. In addition, the peak value of the contact pressure between the photosensitive drum and the intermediate transfer belt in Comparative Example A is relatively lower than those in the present embodiment and Comparative Example B. In addition, it can be found that under a constant peak pressure, when the toner image is formed using the liquid developer, it is possible to further prevent the occurrence of a dropout compared to when the toner image is formed using the dry developer.

The above study results can be summarized as shown in Table 3.

TABLE 3

| | Liquid developer | Dry developer |
|---|---|---|
| Physical nip formed | (First embodiment)<br>No streak image occurred<br>No dropout occurred | (Comparative Example B)<br>No streak image occurred<br>Dropout occurred |
| No physical nip formed | (Comparative Example A)<br>Streak image occurred<br>No dropout occurred | (Example in related art)<br>Streak image occurred<br>No dropout occurred |

In the image forming apparatus of the present embodiment, the toner image was formed using the liquid developer, and the primary transfer roller was disposed such that the physical nip was formed in the primary transfer portion. Since the liquid developer was used, the cohesive force of the toner was further reduced compared to when the dry developer was used, and the occurrence of a dropout was prevented even when the pressure in the transfer nip increased. Since the physical nip was formed in the primary transfer portion, an undulation of the intermediate transfer belt was prevented from occurring in the transfer nip, and the occurrence of a streak image was prevented. In this way, it is possible to prevent both the occurrence of a streak image and the occurrence of a dropout.

Second Embodiment

When a metal roller is used as the primary transfer roller 53 as with the first embodiment, the pressure in the primary transfer nip may become unstable. The present embodiment is an embodiment which is made in light of such a case.

Generally, the photosensitive drum has some level of eccentricity due to component processing accuracy, a mass production variation, or the like. For this reason, the pressure in the primary transfer nip changes with the period of the photosensitive drum during driving. Particularly, when a hard material such as a metal is used in the primary transfer roller, the pressure change is noticeable, and the occurrence of a scratch on the photosensitive drum is promoted depending on cases.

In the present embodiment, the intermediate transfer belt 51 is provided with an elastic layer 512, and owing to elastic deformation of the elastic layer 512, the influence of the pressure change is reduced, and similar to the first embodiment, both the occurrence of a streak image and the occurrence of a dropout are prevented.

Since the second embodiment of the present invention is applied to the same image forming apparatus as that described in the first embodiment, descriptions of the image forming apparatus and the primary transfer portion will be omitted.

Figure 8:
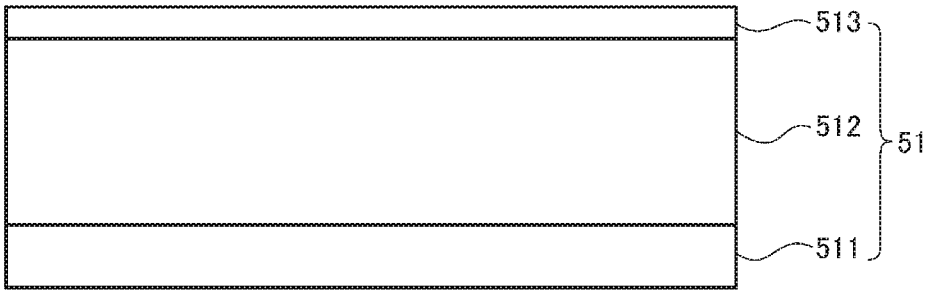
FIG. 8 is a cross-sectional configuration view of an intermediate transfer belt 51 in the second embodiment of the present invention.

FIG. 8 illustrates a cross-sectional configuration of the intermediate transfer belt in the present embodiment. Similar to the first embodiment, the intermediate transfer belt 51 is an endless belt having a constant thickness; however, the elastic layer 512 is formed on a base layer 511, and a surface layer 513 is further formed on the elastic layer 512. The base layer 511 which is made of a resin such as polyimide or polyamide or an alloy thereof containing a proper amount of an antistatic agent such as carbon black is used. The base layer 511 has a surface resistivity of 1E+9 to 1 E+13Ω/□ and the thickness thereof is from 0.04 to 0.1 mm. The elastic layer 512 is made of various rubbers containing a proper amount of an electronic conductive agent, an ionic conductive agent, or both, and has a thickness of 0.2 mm to 2 mm. A rubber material which is not encroached by the liquid developer is desirable, and for example, urethane is suitable. In the present embodiment, the elastic layer 512 is made of a urethane rubber. The surface layer 513 is made of a urethane resin or the like, and as needed, a filler or a resistance adjuster which adjusts the surface energy can be added thereto. It is desirable that the surface layer 513 has a thickness of 20 μm or less.

In regard to the foregoing scratch of the photosensitive drum, in order to avoid a sharp pressure change in the physical nip which is caused by the eccentricity of the photosensitive drum 1, the elastic deformation of the elastic layer 512 in the physical nip of the primary transfer nip only has to exceed the amount of eccentricity of the photosensitive drum 1. In the present embodiment, the photosensitive drum 1 has a maximum eccentricity of 20 μm including processing accuracy, a mass production variation, and the like. Namely, when the amount of deformation of the intermediate transfer belt 51 exceeds 20 μm, the foregoing scratch is avoidable.

Figure 9:
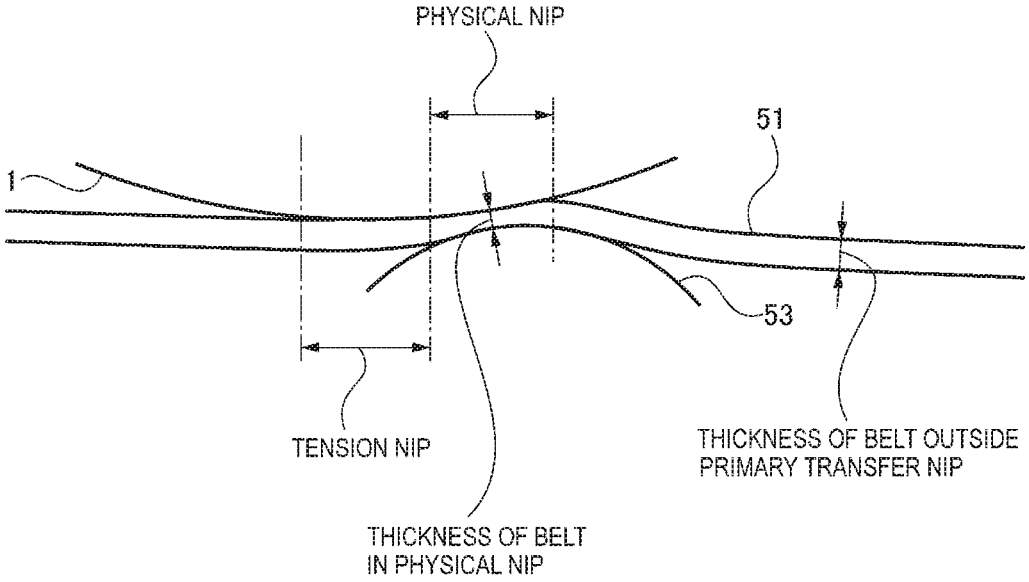
FIG. 9 is a view describing the thickness of the intermediate transfer belt 51 in a physical nip in the second embodiment of the present invention.
Figure 10:
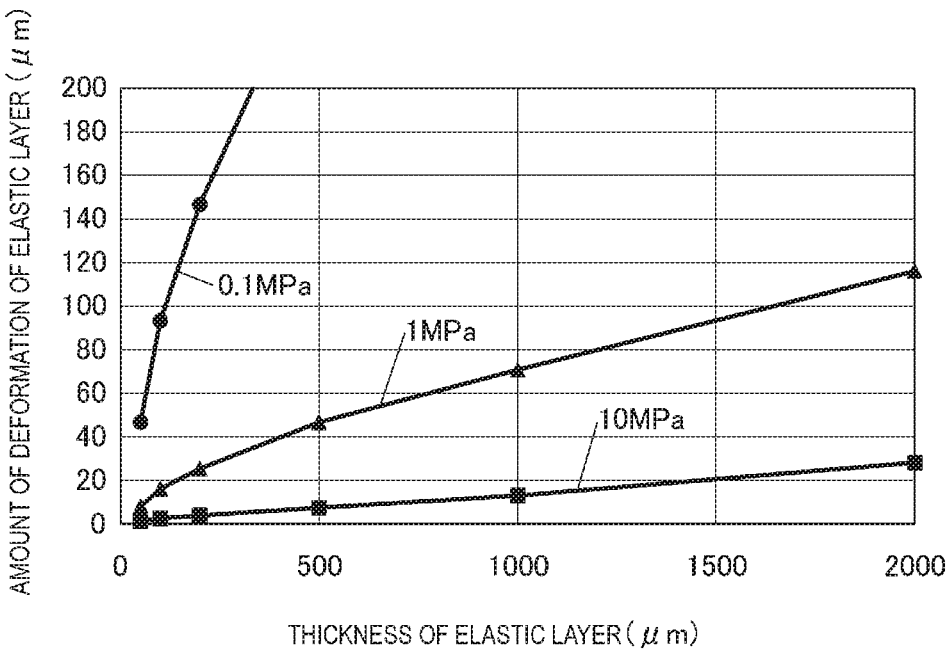
FIG. 10 is a graph showing a relationship between the thickness of an elastic layer 512 and the amount of deformation of the intermediate transfer belt 51 in the second embodiment of the present invention.

The inventors of this application calculated the amount of deformation of the intermediate transfer belt 51 when the intermediate transfer belt 51 in the present embodiment was used in the image forming apparatus 100. Hereinafter, the method will be described. As illustrated in FIG. 9, the amount of deformation of the intermediate transfer belt 51 in the physical nip was calculated by observing the intermediate transfer belt 51 in the physical nip and outside the primary transfer nip from a front direction of the image forming apparatus 100, and comparing the observed length thereof with a scale of known length. FIG. 10 shows plots of the amount of deformation of the intermediate transfer belt 51 when the Young's modulus and the thickness of the elastic layer 512 are varied. As can be seen from FIG. 10, the smaller the Young's modulus is, the larger the amount of deformation is, and the larger the thickness is, the larger the amount of deformation is. When the Young's modulus of the elastic layer 512 was 0.1 MPa, even with a thickness of 100 μm, the amount of deformation of 70 μm was observed. On the other hand, when the Young's modulus was 10 MPa, a thickness of 2,000 μm was required to obtain the amount of deformation of 20 μm. The Young's modulus was measured using a hardness meter FISHERSCOPE manufactured by Fischer Instruments K. K., and the Young's modulus of a single layer of the elastic layer 512 before the belt member is formed was measured. Specifically, an indentation Young's modulus EIT was calculated from a stress-strain curve of a specimen which was measured using a Vickers indenter according to ISO 14577-1.

Subsequently, when an image output was performed by the image forming apparatus 100 using the intermediate transfer belt 51 of the present embodiment, in a case where the thickness exceeded 2,000 μm, there occurred an image defect such as the output image rubbing against a toner image. A surface velocity difference between an image bearing member and a transfer receiving member is considered to be the cause of the occurrence of such an image defect. Namely, since the intermediate transfer belt 51 has a bent shape in a primary transfer nip N4, as the thickness of the intermediate transfer belt 51 is increased, the surface velocity of the intermediate transfer belt 51 in the nip changes. However, since the surface velocity of the photosensitive drum 1 is substantially constant, there occurs a velocity difference between both. The same phenomenon occurs between the intermediate transfer belt 51 and the recording material S in a secondary transfer nip N5. It is considered that due to the surface velocity difference between the image bearing member and the transfer receiving member, the toner image is subjected to rubbing in the primary transfer nip N4 or the secondary transfer nip N5, and thus the foregoing image defect occurs.

Subsequently, when a continuous image output was performed by the image forming apparatus 100 using the intermediate transfer belt 51 of the present embodiment, in a case where the Young's modulus of the elastic layer 512 was less than 0.1 MPa, the continuous image output caused a scratch to occur on the surface of the intermediate transfer belt 51. In addition, a vertical streak-shaped image defect occurred in the output image at a location where the scratch occurred. It is considered that such an image defect is caused by a difference in elastic deformation between a portion of the intermediate transfer belt 51 which is in contact with the recording material S and a portion thereof which is not in contact with the recording material S in the secondary transfer nip N5. Namely, since a larger pressure is exerted on the portion of the intermediate transfer belt 51 which is in contact with the recording material S than on the portion thereof which is not in contact with the recording material S, the amount of deformation becomes large. This tendency is more noticeable as the Young's modulus of the elastic layer 512 becomes smaller, and is more noticeable as the thickness of the recording material S becomes larger. Since a portion of the intermediate transfer belt 51 where the amount of deformation is large and a portion thereof where the amount of deformation is small are adjacent to each other in end portions of the recording material S in a longitudinal direction of the recording material S in the secondary transfer nip N5, a large stress is applied to the surface layer 513. When the continuous image output is performed, the stress is continuously applied to the intermediate transfer belt 51 at positions corresponding to the end portions of the recording material S, and thus a scratch easily occurs on the surface layer 513. When an image is output on a large-width sheet after a scratch occurs on the surface layer 513 due to a continuous image output being performed on small-width sheets, a transfer defect of a toner image occurs on an output image at a location where the scratch occurs.

The above study results can be summarized as shown in Table 4.

TABLE 4

| | | Young's modulus [MPa] | | | |
|---|---|---|---|---|---|
| | | To 0.1 | 0.1 | 10 | From 10 |
| Thickness [mm] | To 0.1 | Δ | Δ | Δ | X |
| | | X | ○ | ○ | ○ |
| | | ○ | ○ | ○ | ○ |
| | 0.1 | ○ | ○ | Δ | X |
| | | X | ○ | ○ | ○ |
| | | ○ | ○ | ○ | ○ |
| | 2 | ○ | ○ | Δ | X |
| | | X | ○ | ○ | ○ |
| | | ○ | ○ | ○ | ○ |
| | From 2 | ○ | ○ | ○ | Δ |
| | | X | ○ | ○ | ○ |
| | | X | X | X | X |

(Upper row: amount of elastic deformation, middle row: scratch on intermediate transfer belt, lower row: rubbing of image, ○: no problem occurred, X : problem occurred, Δ: depending on condition)

The symbol □ in Table 4 indicates that the results depend on the pressing force of the primary transfer roller 53. Namely, when the pressing force is increased, the amount of deformation of the elastic layer 512 also becomes large, and thus a pressing force to cause the amount of deformation to be 20 μm or greater only has to be selected. As described above, when the Young's modulus of the elastic layer 512 is within a range of 0.1 MPa to 10 MPa and the thickness of the elastic layer 512 is within a range of 0.1 mm to 2 mm, it is possible to prevent the occurrences of a scratch on the drum, a scratch on the intermediate transfer belt, and the rubbing of an image.

Figure 11:
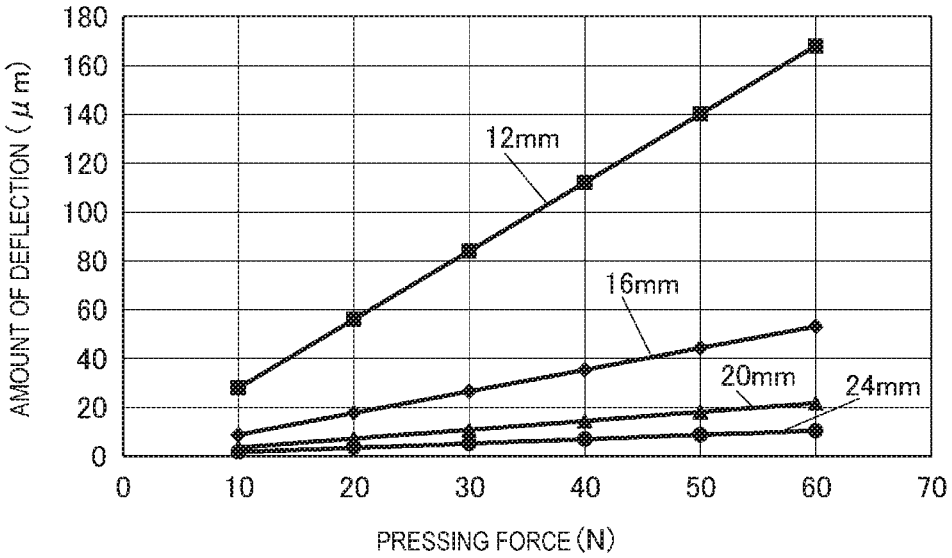
FIG. 11 is a graph showing a relationship between the pressing force and the amount of deflection of a primary transfer roller 53 in the second embodiment of the present invention.

By the way, when the pressing force is increased, deflection occurs in the primary transfer roller 53, so that the target amount of deformation may not be obtained. FIG. 11 shows a relationship between the outer diameter of the primary transfer roller 53, the pressing force, and the amount of deflection. The amount of deflection is obtained by calculating a difference in the amount of deflection between an end portion and a central portion of a simple solid cylindrical beam when a load which is uniform in a longitudinal direction is exerted on the beam. In the present embodiment, since the outer diameter of the primary transfer roller 53 is 24 mm and the pressing force is 40 N, it can be found that the amount of deflection is approximately 7 μm. In the present embodiment, even though the deflection of the primary transfer roller 53 is taken into consideration, when the Young's modulus and the thickness of the elastic layer 512 are within the foregoing ranges, a sufficient amount of deformation can be obtained; however, when the diameter of the primary transfer roller is reduced or when the pressing force is increased, it is necessary to take the deflection of the primary transfer roller into consideration.

In order to demonstrate the effects of the present invention, it was confirmed whether or not a scratch occurred on the surface of the photosensitive drum 1 when an intermediate transfer belt of which the elastic layer 512 had a Young's modulus of 1 MPa and a thickness of 500 μm was used. As a comparative example, study was also conducted on an intermediate transfer belt having only a base layer. As a method of the study, a photosensitive drum having the amount of eccentricity of 20 μm was prepared, 5,000 sets of image formation were performed on 100 sheets of A4-size recording materials using each of the intermediate transfer belts, and a surface of the photosensitive drum was observed before and after the study with an optical microscope.

Table 5 shows whether or not a scratch occurs on the photosensitive drum, and the amount of deformation of the intermediate transfer belt.

TABLE 5

| | Occurrence of scratch on photosensitive drum (initial) | Occurrence of scratch on photosensitive drum (after study) | Amount of deformation of intermediate transfer belt [μm] |
|---|---|---|---|
| Present embodiment | Not occurred | Not occurred | 47 |
| Comparative example | Not occurred | Occurred | Measurement limit or less |

As shown in Table 5, in the comparative example, the amount of deformation of the intermediate transfer belt could not be confirmed, and a scratch on the photosensitive drum was observed. On the other hand, in the present embodiment, the amount of deformation of the intermediate transfer belt was 47 μm, which exceeded the amount of eccentricity of 20 μm in the photosensitive drum even though the amount of deflection of the primary transfer roller was taken into consideration, and the occurrence of a scratch on the photosensitive drum was not also confirmed after the study. In addition, in the present embodiment, as described above, a scratch on the belt or the rubbing of an image was not also observed.

As described above, it can be found that when the elastic layer is provided on the intermediate transfer belt and in the physical nip of the primary transfer nip, the amount of deformation of the intermediate transfer belt exceeds the amount of eccentricity of the photosensitive drum, the occurrence of a scratch on the photosensitive drum caused by the eccentricity of the photosensitive drum can be prevented. In a case where at least the transfer pressure in the present embodiment is applied, when the Young's modulus of the elastic layer is from 0.1 MPa to 10 MPa and the thickness of the elastic layer is from 0.1 mm to 2 mm, it is possible to prevent the occurrence of a scratch on the intermediate transfer belt or the rubbing of an image.

Since the intermediate transfer belt 51 described above is used in the image forming apparatus 100 which is the same as that in the first embodiment, similar to the first embodiment, a toner image is formed using the liquid developer and the physical nip is formed in the primary transfer portion, as a result, it is possible to prevent both the occurrence of a streak image and the occurrence of a dropout.

In the present embodiment, a case where a metal roller made of a metal is used as the primary transfer roller 53 has been described; however, for example, as long as the primary transfer roller 53 can be regarded as a substantially rigid body, a thin resin layer may be provided in the surface layer. For example, in the present embodiment, a roller provided with a resin layer of approximately several microns may be regarded as a metal roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

a photosensitive drum configured to bear an image;

a developing device configured to develop a latent image, which is formed on the photosensitive drum, into a toner image with a liquid developer containing a toner particle and a carrier liquid;

an intermediate transfer belt onto which the toner image formed on the photosensitive drum is transferred; and a transfer roller configured to nip the intermediate transfer belt with the photosensitive drum, and configured to be applied a transfer bias to transfer the toner image, which is formed on the photosensitive drum, onto the intermediate transfer belt, wherein the transfer roller is a metal roller, and wherein the intermediate transfer belt includes an elastic layer having a Young's modulus of 0.1 MPa to 10 MPa and a thickness of 0.1 mm to 2 mm.

2. The image forming apparatus according to claim 1, wherein the intermediate transfer belt includes a base layer made of a polyimide or a polyamide containing a carbon black.

3. The image forming apparatus according to claim 1, wherein a linear nipping pressure of the transfer roller with respect to the intermediate transfer belt is from 0.01 N/mm to 0.15 N/mm.

4. An image forming apparatus comprising:

a photosensitive drum configured to bear an image;

a developing device configured to develop a latent image, which is formed on the photosensitive drum, into a toner image with a liquid developer containing a toner particle and a carrier liquid;

an intermediate transfer belt onto which the toner image formed on the photosensitive drum is transferred; and a transfer roller configured to nip the intermediate transfer belt with the photosensitive drum, and configured to be applied a transfer bias to transfer the toner image, which is formed on the photosensitive drum, onto the intermediate transfer belt, wherein the transfer roller is a metal roller, and wherein a viscosity of the liquid developer is from 0.5 to 100 cP.

5. An image forming apparatus comprising:

a photosensitive drum configured to bear an image;

a developing device configured to develop a latent image, which is formed on the photosensitive drum, into a toner image with a liquid developer containing a toner particle and a carrier liquid;

an intermediate transfer belt onto which the toner image formed on the photosensitive drum is transferred; and a transfer roller configured to nip the intermediate transfer belt with the photosensitive drum, and configured to be applied a transfer bias to transfer the toner image, which is formed on the photosensitive drum, onto the intermediate transfer belt, wherein the transfer roller is a metal roller, wherein the intermediate transfer belt includes a base layer and an elastic layer, and wherein the elastic layer has a Young's modulus of 0.1 MPa to 10 MPa.

6. An image forming apparatus comprising:

a photosensitive drum configured to bear an image;

a developing device configured to develop a latent image, which is formed on the photosensitive drum, into a toner image with a liquid developer containing a toner particle and a carrier liquid;

an intermediate transfer belt onto which the toner image formed on the photosensitive drum is transferred; and a transfer roller configured to nip the intermediate transfer belt with the photosensitive drum, and configured to be applied a transfer bias to transfer the toner image, which is formed on the photosensitive drum, onto the intermediate transfer belt, wherein the transfer roller is a metal roller having a surface layer made of a resin, and wherein the intermediate transfer belt includes a base layer and an elastic layer, and wherein the elastic layer has a Young's modulus of 0.1 MPa to 10 MPa.

7. The image forming apparatus according to claim 6, wherein the elastic layer has a thickness of 0.1 mm to 2 mm.

8. The image forming apparatus according to claim 6, wherein the intermediate transfer belt includes a surface layer made of a resin and having a thickness of 20 μm or less.

* * * * *